US009322625B1

(12) United States Patent
Langner

(10) Patent No.: US 9,322,625 B1
(45) Date of Patent: Apr. 26, 2016

(54) SYSTEMS AND METHODS FOR LAUNCHING WATER FROM A DISRUPTER CANNON

(71) Applicant: F. Richard Langner, Fountain Hills, AZ (US)

(72) Inventor: F. Richard Langner, Fountain Hills, AZ (US)

( * ) Notice: Subject to any disclaimer, the term of this patent is extended or adjusted under 35 U.S.C. 154(b) by 0 days.

(21) Appl. No.: 14/809,584

(22) Filed: Jul. 27, 2015

Related U.S. Application Data

(63) Continuation-in-part of application No. 13/616,874, filed on Sep. 14, 2012, now abandoned.

(60) Provisional application No. 61/659,414, filed on Jun. 13, 2012, provisional application No. 61/628,006, filed on Oct. 24, 2011, provisional application No. 61/628,115, filed on Oct. 25, 2011.

(51) Int. Cl.
*F42B 33/06* (2006.01)
*F42B 5/02* (2006.01)

(52) U.S. Cl.
CPC ..... *F42B 33/062* (2013.01); *F42B 5/02* (2013.01)

(58) Field of Classification Search
CPC ..... F42D 5/04; F42B 33/062
USPC ..... 86/50
See application file for complete search history.

(56) References Cited

U.S. PATENT DOCUMENTS

| | | | |
|---|---|---|---|
| 431,601 | A | 7/1890 | Lorenz |
| 932,562 | A | 12/1908 | Muenzenmaier |
| 2,394,249 | A | 12/1941 | McGahey, Jr. |
| 3,046,891 | A | 11/1955 | Treat, Jr. |
| 2,865,371 | A | 12/1958 | Dorbecker |
| 3,279,373 | A | 10/1966 | Stadler |
| 3,292,541 | A | 12/1966 | Stadler |
| 3,363,562 | A | 1/1968 | Stadler |
| 3,363,564 | A | 1/1968 | Gawlick |

(Continued)

FOREIGN PATENT DOCUMENTS

| | | |
|---|---|---|
| EP | 051119 | 5/1982 |
| EP | 120215 | 10/1984 |

(Continued)

OTHER PUBLICATIONS

U.S. Appl. No. 13/616,874, filed Sep. 14, 2012, Systems and Methods for Reducing an Amount of an Expanding Gas that Bypasses a Cartridge.

(Continued)

*Primary Examiner* — Reginald Tillman, Jr.
(74) *Attorney, Agent, or Firm* — Letham Law Firm LLC; Lawrence Letham

(57) ABSTRACT

A water-resistant cartridge includes a pyrotechnic that when ignited launches water from a disrupter cannon to disable and/or destroy an explosive device. The cartridge includes a seal that seals between an outer surface of the cartridge and an inner surface of the barrel to limit water that escapes from the barrel rearward of the seal and cartridge. Prior to launching the water, the water in the barrel surrounds the cartridge forward of the seal. As the pyrotechnic burns and provides an expansive force on the sides of the cartridge, the water between the sides of the cartridge and the inner surface of the barrel resists the expansive force to help retain the shape of the cartridge, so that it may be more easily removed from the barrel after firing. The force provided by the pyrotechnic blows a cover of the cartridge off to provide the force directly to the water to launch the water.

15 Claims, 4 Drawing Sheets

(56) References Cited

U.S. PATENT DOCUMENTS

| | | | |
|---|---|---|---|
| 3,363,565 | A | 1/1968 | Walther |
| 3,415,192 | A | 12/1968 | Stadler |
| 3,455,244 | A | 4/1969 | Ballreich |
| 3,577,923 | A | 5/1971 | Perkins |
| 3,602,283 | A | 8/1971 | Schlack |
| 3,722,411 | A | 3/1973 | Herter |
| 3,726,219 | A | 4/1973 | Bolick |
| 3,732,821 | A | 5/1973 | Royer |
| 3,741,122 | A | 6/1973 | Kordas, Jr. |
| 3,916,792 | A | 11/1975 | Elmore |
| 3,948,178 | A | 4/1976 | Luther |
| 4,169,403 | A | 10/1979 | Hanson |
| 4,206,707 | A | 6/1980 | Shores |
| 4,315,462 | A | 2/1982 | Vollers |
| 4,615,488 | A | 10/1986 | Sands |
| 4,779,511 | A | 10/1988 | Proctor |
| 4,813,343 | A | 3/1989 | Schaefer |
| 4,928,574 | A | 5/1990 | Golden |
| 5,134,921 | A | 8/1992 | Breed |
| 5,136,920 | A | 8/1992 | Breed |
| 5,148,750 | A | 9/1992 | Becker |
| 5,284,274 | A | 2/1994 | Lee |
| 5,292,134 | A | 3/1994 | Schlundt |
| 5,411,225 | A | 5/1995 | Lannon |
| 5,448,937 | A | 9/1995 | Buc |
| 5,454,323 | A | 10/1995 | Conil |
| 5,574,245 | A | 11/1996 | Buc |
| 5,743,246 | A | 4/1998 | Mattern |
| 5,785,038 | A | 7/1998 | Mattern |
| 5,819,717 | A | 10/1998 | Johnson |
| 5,844,163 | A | 12/1998 | Lindskog |
| 6,119,955 | A | 9/2000 | Starr |
| 6,272,996 | B1 | 8/2001 | O'Brien |
| 6,408,731 | B1 | 6/2002 | Elsener |
| 6,439,127 | B1 | 8/2002 | Cherry |
| 6,644,166 | B2 | 11/2003 | Alexander |
| 6,688,032 | B1 | 2/2004 | Gonzalez |
| 6,824,076 | B2 | 11/2004 | Harris |
| 7,066,093 | B2 | 6/2006 | Ronn |
| 7,317,662 | B2 | 1/2008 | Unsworth |
| 7,555,977 | B2 | 7/2009 | Crotty |
| 7,712,417 | B1 | 5/2010 | Einstein |
| 7,905,182 | B2 | 3/2011 | Janik |
| 7,997,179 | B1 | 8/2011 | Nelson |
| 8,245,430 | B1 | 8/2012 | Owenby |
| 8,616,129 | B1 | 12/2013 | Borrow |
| 2003/0041722 | A1 | 3/2003 | Alexander |
| 2003/0047062 | A1 | 3/2003 | Alexander |
| 2003/0173754 | A1 | 9/2003 | Bryant |
| 2007/0164531 | A1 | 7/2007 | Bryant |
| 2007/0278779 | A1 | 12/2007 | Arnold |
| 2008/0282922 | A1 | 11/2008 | Land |
| 2009/0178548 | A1 | 7/2009 | Tyas |
| 2010/0212481 | A1 | 8/2010 | Koth |
| 2011/0214583 | A1 | 9/2011 | Dutch |
| 2011/0315038 | A1 | 12/2011 | DeHimerRome |
| 2011/0315710 | A1 | 12/2011 | Ma |
| 2012/0174813 | A1 | 7/2012 | Battaglia |
| 2013/0228579 | A1 | 9/2013 | Ballard |

FOREIGN PATENT DOCUMENTS

| | | |
|---|---|---|
| EP | 424057 | 4/1991 |
| EP | 549659 | 7/1993 |
| EP | 784778 | 7/1997 |
| EP | 784998 | 7/1997 |
| EP | 1055096 | 11/2000 |
| EP | 1084376 | 3/2001 |
| GB | 470250 | 8/1937 |
| GB | 875241 | 8/1961 |
| GB | 1174276 | 12/1969 |
| WO | 9511419 | 4/1995 |

OTHER PUBLICATIONS

U.S. Appl. No. 13/616,987, filed Sep. 14, 2012, Systems and Methods for a Firing Pin.

U.S. Appl. No. 13/617,089, filed Sep. 14, 2012, Systems and Methods for Increasing a Force of Delivery of a Liquid from a Disrupter Cannon.

U.S. Appl. No. 13/797,137, filed Mar. 12, 2013, Systems and Methods for Ammunition for a Disrupter Cannon.

SYSTEMS AND METHODS FOR LAUNCHING WATER FROM A DISRUPTER CANNON

FIELD OF THE INVENTION

Embodiments of the present invention relate to disrupter cannons used to disable explosive devices.

BACKGROUND OF THE INVENTION

Disrupter cannons are used by military, bomb squad, and other emergency service personnel to destroy and/or disable explosive devices including improvised explosive devices ("IED"), bombs, and ordinance.

Disrupter cannons propel a projectile to impact the explosive device. Impact of the projectile with the explosive device may interfere with (e.g., damage, destroy) a portion of the explosive device to disable the explosive device. Impact of the projectile with the explosive device may trigger (e.g., start, initiate, cause) explosion of the explosive device thereby destroying the device.

Disrupter cannons may benefit from improvements, according to the various aspects of the present invention that increase a force of delivery of a liquid projectile, decrease an amount of powder residue that enters a firing assembly, and improve the reliability of the operation of the firing assembly.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
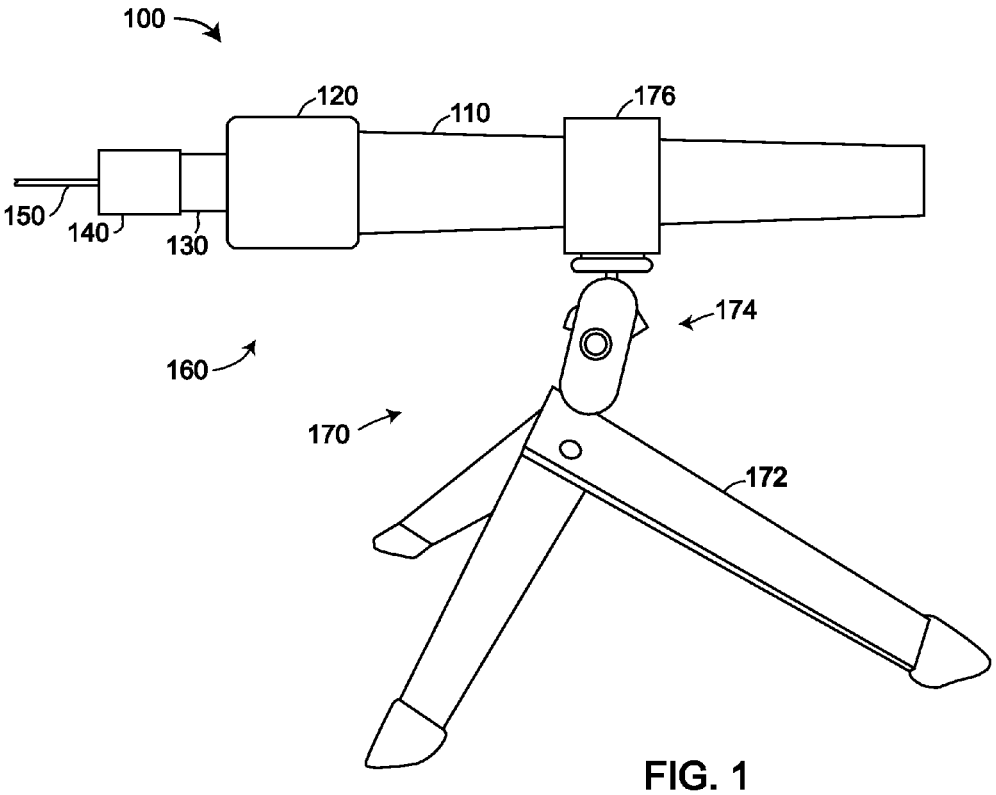
FIG. 1 is a plan view of a disrupter system.

The disclosure of U.S. patent application Ser. No. 13/616,874 ("874") filed Sep. 14, 2012 and entitled "Systems and Methods for Reducing an Amount of an Expanding Gas that Bypasses a Cartridge" is incorporated herein by reference for any and all purposes.

Disrupter system 100 may be used to disable and/or destroy explosive devices. Disrupter cannon 160 may propel a projectile for disabling and/or destroying the explosive device. Mount 170 positions and supports disrupter cannon 160 for propelling a projectile toward an explosive device.

Holder 176 holds (e.g., clamps to, secures, supports) disrupter cannon 160 and couples to positioner 174. Holder 176 may retain disrupter cannon 160 prior to firing disrupter cannon 160. Holder 176 may retain disrupter cannon 160 after firing disrupter cannon 160. Holder 176 may release disrupter cannon 160 responsive to a recoil force to allow disrupter cannon 160 to separate from holder 176 and thereby from mount 170.

Positioner 174 moves to position disrupter cannon 160 so that the trajectory of the projectile launched by disrupter cannon 160 is directed toward the explosive device. Positioner 174 may orient disrupter cannon 160 so that the muzzle of barrel 110 of disrupter cannon 160 is oriented in an upward, a downward, or a horizontal direction with respect to the ground (e.g., a direction of a force of gravity). The position of positioner 174 may be locked (e.g., held) to retain the orientation (e.g., aim) of disrupter cannon 160.

Tripod 172 supports the weight of disrupter cannon 160. Tripod 172 may include any conventional tripod or support for supporting conventional equipment (e.g., cameras, guns, cannons). Tripod 172 may be position an effective distance, with respect to the range of the projectile used, away from an explosive device. An effective distance may be in the range of 6 to 48 inches, preferably 16 to 22 inches. Tripod 172 may move responsive to a recoil force of firing disrupter cannon 160. In an implementation where disrupter cannon 160 separates from holder 176 due to a force of recoil, tripod 172 may remain unmoved during and after firing disrupter cannon 160.

Disrupter cannon 160 may include cover 140, firing assembly 130, breech cap 120, and barrel 110. Disrupter cannon 160 may cooperate with shock tube 150 and cartridge 380 to launch a projectile. Fire assembly 130 includes a firing pin 320 that activates a primer of a cartridge to launch a projectile.

The type of projectile launched toward an explosive device may be selected to disable and/or destroy the explosive device. The projectile type may include a structure suitable for disabling and/or destroying a particular type of explosive device. A projectile may include one or more objects having physical features (e.g., balls, fragments, pointed structure, snub nose) for propelling toward a target. The objects of a projectile may be held together prior to launch in a container (e.g., shell). A projectile may include water.

The material (e.g., composition, type, substance) of a projectile may be selected to disable and/or destroy an explosive device. Materials may include metal, clay, plastic, and liquids. Materials of a projectile may include any combination of materials, for example, portions of the projectile formed of different metals (e.g., aluminum, titanium).

The material of a projectile may be further selected to protect personnel in the vicinity of the explosive device. For example, a projectile may be formed of a frangible material (e.g., compressed powder) that breaks apart (e.g., disperses) on impact. A projectile may include a mass (e.g., body, amount) of a liquid. A liquid may include water. A mass of a liquid may be propelled from a disrupter cannon to impact an explosive device to disable and/or destroy the explosive device. A liquid may further disperse on impact with an explosive device thereby protecting personnel in the vicinity.

For example, the barrel of a disrupter cannon may be filled with a liquid and the liquid propelled toward an explosive device. On impact, the liquid may move, cut, penetrate, disable, and/or destroy the explosive device depending on an amount of force applied by the liquid to the explosive device.

A liquid projectile increases the safety of dealing with explosive devices because the liquid disperses on impact and may dampen (e.g., wet) any explosive materials ejected from the explosive device thereby decreasing the likelihood of explosion. However, presently liquid projectiles are less effective than a solid projectile, including compressed powders, because the force delivered by a liquid projectile is less than the force delivered by a solid projectile.

According to various aspects of the present invention, disrupter cannon 160 may cooperate with a water-resistant cartridge to increase the effectiveness of a liquid projectile.

A disrupter cannon propels a projectile by producing a rapidly expanding gas. The rapidly expanding gas is generally produced by burning a pyrotechnic (e.g., gun powder, explosive charge). Generally, the pyrotechnic is held in a cartridge. Cartridges used to launch projectiles from a disrupter cannon are generally considered a high-load cartridge because they contain more pyrotechnic than a typical cartridge for a shotgun. Many cartridges used in disrupter cannons are the same size as a standard shot gun shell in which the cartridge contains with pyrotechnic and the projectile.

Firing (e.g., activating, igniting) the cartridge used in a disrupter cannon burns the pyrotechnic. Due to the high load of pyrotechnic in cartridges used in disrupter cannons, the expansive force of the burning pyrotechnic may expand the cartridge case (e.g., casing) so that the sides of the casing contact the inner surface of the barrel thereby making it difficult to remove the expended cartridge from the barrel after firing.

As discussed above, a pyrotechnic produces a rapidly expanding gas. A pyrotechnic may experience a chemical reaction (e.g., burning) to produce the rapidly expanding gas. The rapidly expanding gas may provide a force. The force may launch a projectile. A magnitude of a force provided by a rapidly expanding gas may vary over time. Variance of the magnitude of the force over time may be referred to as a profile of the force (e.g., force profile). The force profile may start with ignition of the pyrotechnic and end when the pyrotechnic is exhausted.

A chemical composition of a pyrotechnic may be selected and/or formulated to produce a particular force profile. A fast burn force profile may include a rapid peak in the magnitude of the force followed by a rapid decrease in the magnitude of the force provided followed by a decreased magnitude of force until the pyrotechnic is exhausted. A slow burn force profile may include delivery of a near constant magnitude of force from shortly after ignition of the pyrotechnic until the chemical reaction of the pyrotechnic is exhausted.

The magnitude of the maximum force of a force profile may correlate (e.g., be in accordance) with the amount (e.g., load, grains) of pyrotechnic burned. A small load amount of pyrotechnic may provide a maximum magnitude of force while a high load produces a greater maximum magnitude. A particular load may deliver its maximum magnitude of force with a fast burn or a slow burn force profile depending on the type, not the amount, of pyrotechnic in the cartridge.

The terms fast burn and slower burn are used herein to describe the force profile of pyrotechnics used in the cartridges for testing. Fast burn powders are generally used in conventional shot gun shells and pistol cartridges. The physical consistency (e.g., physical characteristics) of a fast burn powder is usually flakey or fine grains. Slow burn powders are generally used in conventional larger caliber magnum rifle cartridges such as a 50 caliber Browning Machine Gun ("BMG"). The consistency of a slow burn powder is usually more granular or pellet-like.

According to various aspects of the present invention, cartridge 380 may cooperate with barrel 110 and water 372 to increase the amount of force transferred from the pyrotechnic to water 372 to increase the effectiveness of water as a projectile. Further, cartridge 380 may cooperate with barrel 110 and water 372 to decrease the expansion of the cartridge during firing so that the cartridge may be easily removed from barrel 110 after firing cartridge 380.

A barrel includes a muzzle end portion (e.g., exit), a breech end portion (e.g., rear), and a bore therebetween. Prior to firing, the bore of the barrel holds (e.g., contains) at least a projectile and a cartridge. Upon firing the cartridge, the barrel in cooperation with breech cap 120, contains, at least in part and for a period of time, the force provided by the rapidly expanding gas generated by burning the pyrotechnic of the cartridge. The barrel and breech cap direct the force provided by the rapidly expanding gas against the projectile. The force moves the projectile from the barrel toward the muzzle end portion of the barrel along the bore until the projectile exits the barrel at the muzzle end portion of the barrel. The barrel establishes, at least at first, an initial flight of the projectile. The projectile continues along the trajectory established by the barrel, at least for a time, after the projectile exits the barrel. A material for a barrel may include a lightweight composite material and a metal.

A diameter of the bore of a barrel may be suitable to allow passage of convention projectiles (e.g., bullet, shell) or to accept any conventional cartridge. In one implementation, the barrel receives a conventional 12-gauge shotgun shell in the breech end of the barrel. A surface of the bore may be smooth or rifled. A length of a barrel for a disrupter cannon may be in the range of 10 inches to 30 inches.

In an implementation, barrel 110 is formed of titanium and an external surface of barrel 110 is wrapped in carbon fiber. In another implementation, barrel 110 is formed of stainless steel.

A breech cap couples to the breech end portion of a barrel. A breech cap forms a chamber at a breech end portion of the barrel. A breech cap retains a cartridge in the breech end portion of a barrel. The breech cap positions the firing assembly for activating the cartridge. A breech cap cooperates with the barrel to contain and direct the force of the rapidly expanding gas provided by the cartridge as discussed above. In operation, the expanding gas provided by a cartridge cannot readily exit the chamber formed at the breech end portion of the barrel, so the breech cap directs the force of the expanding gas toward the muzzle end portion of the barrel and against the projectile.

A coupling between a breech cap and a barrel must be sufficiently strong for the breech cap to remain coupled to the barrel during firing of the cartridge and launch of the projectile. Any coupling mechanism (e.g., threads, bayonet, latch) that can withstand the force of the expanding gas provided by the cartridge is suitable for coupling the breech cap to the barrel. A breech cap may be removably coupled (e.g., hinged, threaded) to a barrel. A breech cap may be completely removable (e.g., disconnected, decoupled) from a barrel.

The coupling between a breech cap and a barrel must be able to be decoupled after firing the cartridge to permit a new cartridge and projectile to be inserted into the barrel for a subsequent launching of the projectile. Preferably, decoupling should be able to be accomplished manually without the use of tools. A coupling that becomes difficult to decouple after the cartridge is fired and the projectile launched reduces the frequency of operation of the disrupter cannon because extra time must be used to remove the breech cap and reload the disrupter cannon.

In an implementation, breech cap 120 threadedly couples to barrel 110 using threads z. In an implementation, threads 314 are coarse ACME threads. Breech cap 120 is manually threaded to barrel 110 to couple breech cap 120 to barrel 110. Preferably, breech cap 120 can be manually unthreaded to decouple breech cap 120 from barrel 110. The thread type may contribute to the effect the expanding gas has on the coupling between the breech cap 120 and barrel 110. Preferably, the thread type increases the likelihood of being able to manually remove, without the use of tools, breech cap 120 from barrel 110 after firing; however, other factors play a role, such as the pyrotechnic used in the cartridge, whether the casing of the cartridge is bent out of shape by firing, and the amount of gas that escapes from the cartridge into the breech end portion of the disrupter cannon.

A firing assembly activates (e.g., fires) the cartridge to launch the projectile. A firing assembly activates the cartridge responsive to an action taken by an operator of the disrupter cannon. A firing assembly may operate as a transducer in that it transforms one form of energy into another form of energy to activate the cartridge.

For example, a firing assembly for an electrically fired cartridge may translate the movement of an operator's digit into an electrical signal that activates the cartridge. A firing assembly for a mechanically fired cartridge may translate an electrical signal or mechanical movement into movement (e.g., displacement) of a firing pin that strikes the cartridge to activate the cartridge. A firing assembly may translate a force provided by an expanding gas into movement of the firing pin to strike the cartridge.

Prior to firing a disrupter cannon, the firing pin of a mechanical firing assembly is positioned away from the cartridge. To fire the cartridge, the firing pin moves toward the cartridge to strike the primer of the cartridge to fire the cartridge. Preferably, after firing the cartridge, the firing pin returns to the pre-firing position to be ready to fire a subsequent cartridge. Preferably, the firing pin returns to the pre-firing position without manual intervention by a human. Generally, a force is applied to move the firing pin from the forward (e.g., firing) position back to the pre-firing position.

In an implementation, shock tube 150 provides a force of an expanding gas to move firing pin 440 from the pre-firing position to the firing position. The expanding gas provided by shock tube 150, as discussed above, is provided by burning a pyrotechnic in the interior bore of the shock tube. The gas provided by the burning pyrotechnic of shock tube 150 moves along a length of shock tube 150 and exits the ends of shock tube 150. One end of shock tube 150 is positioned in the chamber that retains firing pin 320. The gas that exits shock tube 150 applies a force on firing pin 320 that moves firing pin 320 from a pre-firing position to a firing position in which firing pin 320 contacts (e.g., strikes, hits) the primer of cartridge 380.

Figure 2:
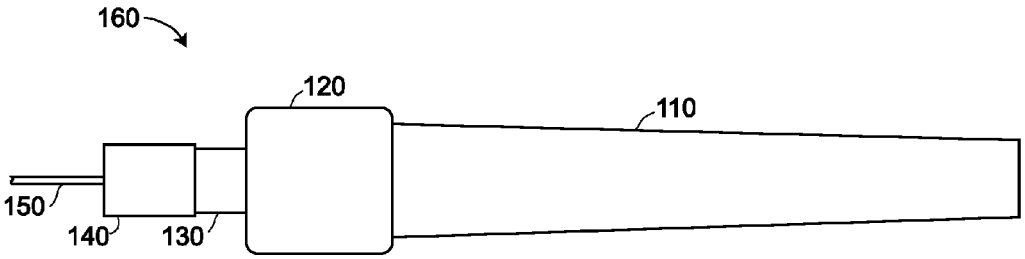
FIG. 2 is a plan view of a disrupter cannon according to various aspects of the present invention.
Figure 3:
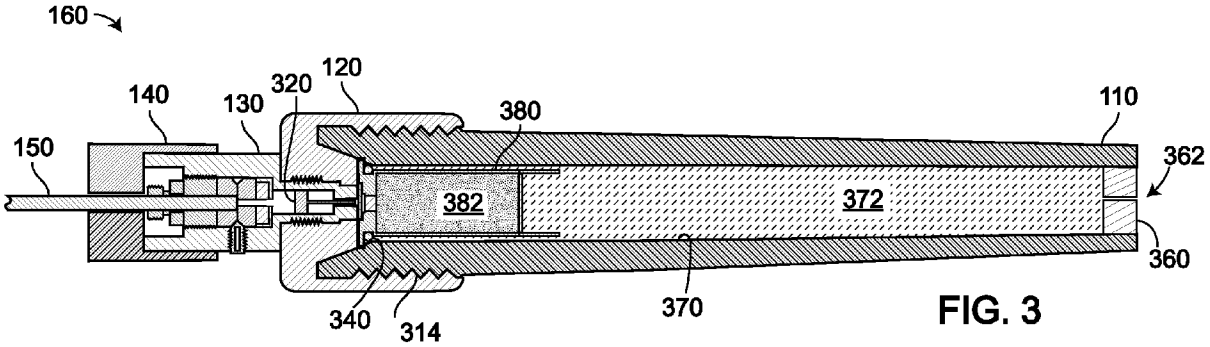
FIG. 3 is a cross-section view of the disrupter cannon of FIG. 2 along a central axis.
Figure 4:
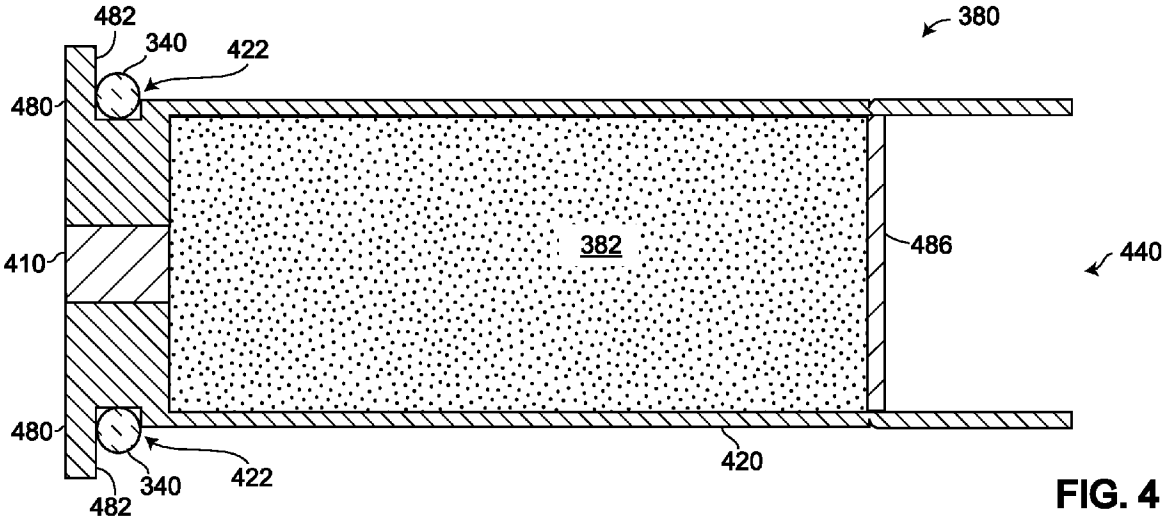
FIG. 4 is the cross-section view of the cartridge from the cross-section view of FIG. 3.
Figure 5:
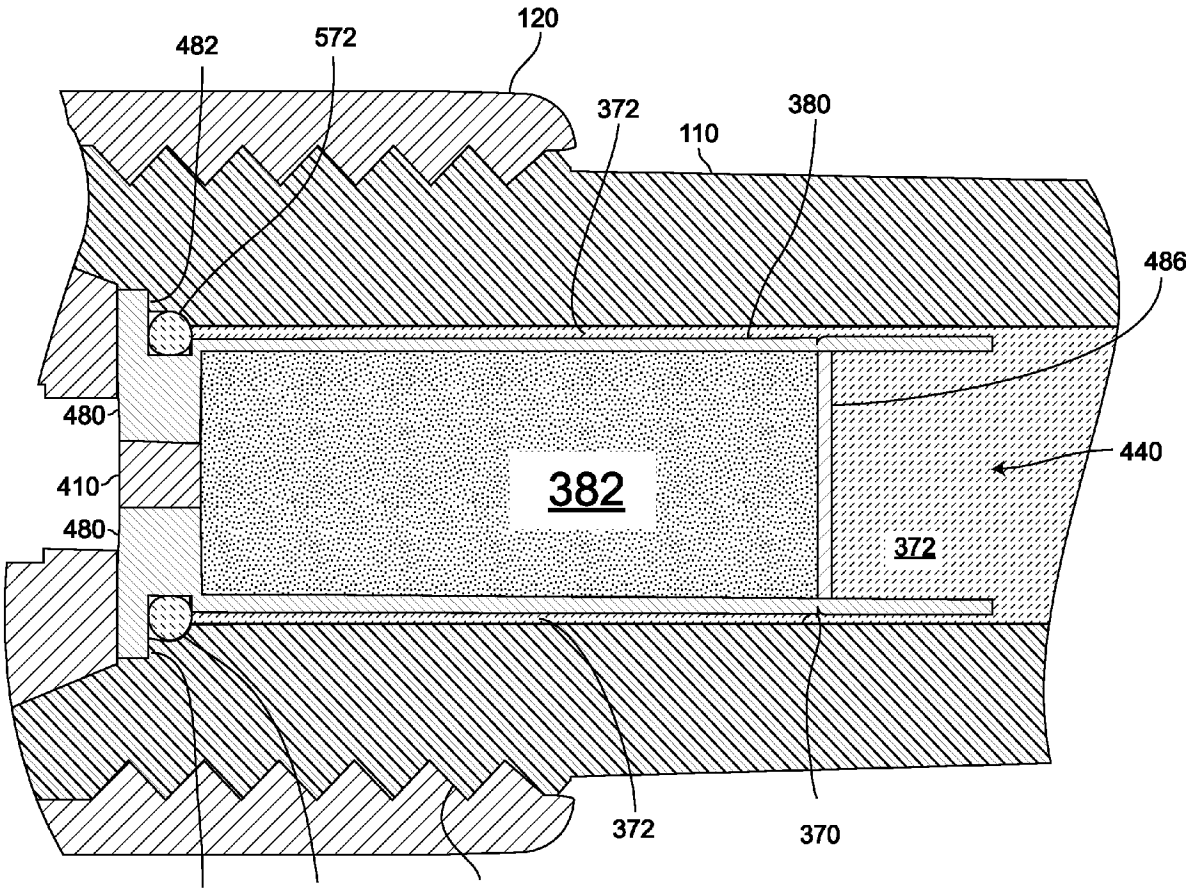
FIG. 5 is a close-up view the cross-section view of FIG. 3 that includes a portion of the barrel, water, and breech proximate to the cartridge.
Figure 6:
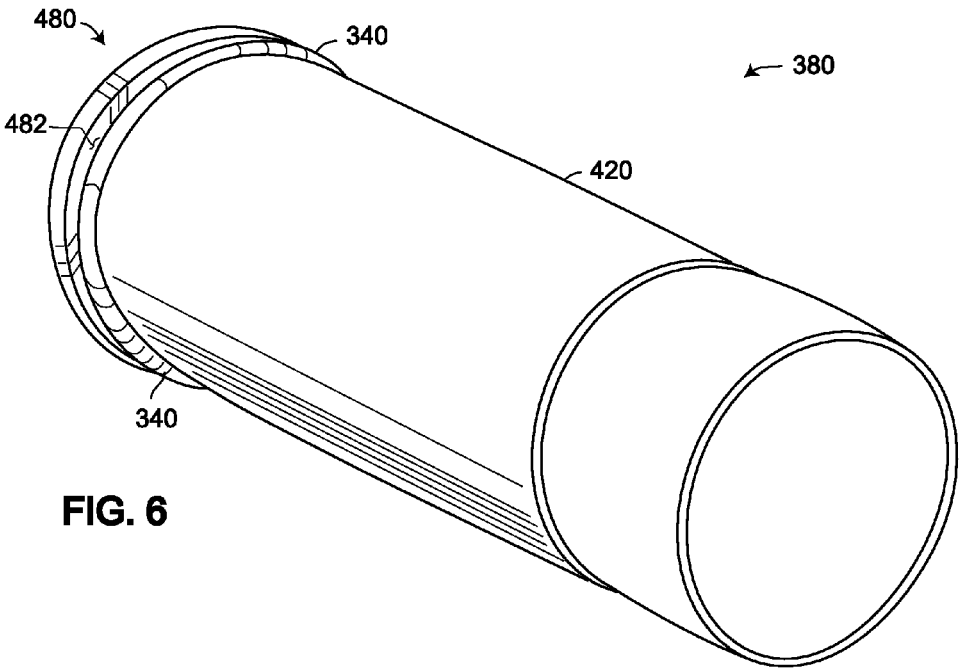
FIG. 6 is a perspective view of the cartridge of FIG. 3 showing the front and left side.

According to various aspects of the present invention, disrupter system 100 of FIGS. 1-6 may launch a projectile formed of water with greater force than conventional disrupter cannons and may decrease distortion (e.g., expansion) of the case of the cartridge caused by firing the cartridge.

To operate disrupter cannon 160 to launch (e.g., fire) a water shot (e.g., projectile of water, column of water, mass of water), cartridge 380 is inserted into bore 370 of barrel 110 from the breech end of barrel 110. Beech cap 120 is coupled to the breech end portion of barrel 110. Barrel 110 is positioned so that the muzzle end portion is facing upward (e.g., opposite direction of gravity). Water 372 is poured into bore 370 of barrel 110 until bore 370 is filled. Plug 360 (e.g., stopper) is pushed into the muzzle end portion of barrel 110. Plug 360 includes hole 362 therethrough so that a portion of water 372 or trapped air may exit from bore 370 if necessary as plug 360 is pushed into barrel 110. Barrel 110 may be filled to within the depth of plug 360. After 360 is inserted into barrel 110, the muzzle end portion of barrel 110 may be positioned downward (e.g., toward direction of gravity) and the water is retained in barrel 110 by plug 360. Because barrel 110 is filled with water 372, water 372 surrounds cartridge 380 rearward to seal 340.

After barrel 110 is filled with water 372, firing assembly 130 may be coupled to breech cap 120. Firing assembly 130 couples to breech cap 130 to position a firing pin along a central axis of barrel 110 and cartridge 380. Shock tube 150 may be inserted into firing assembly 130.

Cartridge 380 includes casing 420, seal 340, primer 410, pyrotechnic 382, and cover 486. Casing 820 includes rear portion 480. Rear portion 480 has forward surface 482. Casing 420 may include channel 422 positioned forward, with respect to the direction of travel of a projectile and the muzzle end portion of barrel 110, of rear portion 480. Channel 422 encircles casing 420.

A casing provides the structure of a cartridge. A casing establishes a size (e.g., caliber, diameter) of the cartridge. A casing establishes the length of a cartridge. A casing establishes a shape of the cartridge. A casing includes a cavity for retaining a pyrotechnic, a bore for receiving primer 410, hollow 440 for optionally receiving a projectile, a surface for sealing with seal 340, and structure for coupling cover 486. A casing may be formed of a water-resistant material. A casing may be formed of any suitable material and coated with a water-resistant material to make the casing water resistant.

A casing when positioned in a barrel positions a primer 410 to cooperate with a firing pin to fire cartridge 380. Rear portion 480 provides structure (e.g., larger diameter, rim, surface) for interfering with (e.g., contacting) a breech end portion of barrel 110 to position cartridge 380 with respect to the breech end portion of barrel 110. Rear portion 480 contacts a breach end portion of barrel 110 to establish the maximum amount cartridge 380 may be inserted into barrel 110. Rear portion 480 includes surface 482 for contacting the breech end portion of barrel 110 to position cartridge 380. Surface 482 may seal with the breech end portion of barrel 110.

Breech cap 120, when coupled to a barrel, may press against rear portion 480 of casing 420. Pressure from breech cap 120 may force surface 482 against the breech end portion of barrel 110 thereby establishing a seal between surface 482 and the breech end portion of barrel 110. A seal between surface 482 and the breech end portion of barrel 110 may reduce an amount of water that passes from barrel 110 rearward of cartridge 380. Restricting the amount of water that passes by a seal between surface 482 and the breech end portion of barrel 110 reduces the likelihood that water will affect the operation of primer 410 or firing assembly 130. Surface 482 may be formed of the same material that forms rear portion 480 of casing 820. Surface 482 may be integral with rear portion 480. Surface 482 may include a coating of a material (e.g., neoprene, rubber, teflon) that enhances the sealing capacity of surface 482.

A seal forms a seal (e.g., barrier). A seal, separate from any possible seal between surface 482 and the breech end portion of barrel 110, may further impede movement of a liquid (e.g., water) from barrel 110. A seal may retain a liquid on one side (e.g., forward side) of a seal and not permit passage of the liquid to the other side (e.g., rearward side) of the seal. A seal may stop water from passing rearward of a cartridge. A seal may protect a primer from becoming moist so that the primer may function as expected. A seal may form a seal with a surface. A seal may form a seal with two or more surfaces and/or between two or more surfaces. A seal may fill, at least partially, a void to form a seal. A seal may have a shape that conforms to one or more surfaces. A seal may be formed of a material that is different from the materials that form the surfaces. A seal may be pliable. A seal may be deformed to confirm to a shape of a surface to form a seal with that surface.

Materials for a seal include neoprene, rubber, and Teflon. A seal may form a seal with an outer surface of a casing. A seal may further form a seal with a surface of the bore of a barrel.A seal may be positioned anywhere along a length of a casing. Preferably, a seal is positioned proximate to rear portion 480 in contact with surface 482 and an outer surface of the casing.

A cover closes an opening. A cover may seal an opening. A cover may be formed of any conventional water-resistant material. A cover may seal an opening of a casing so that the casing is water resistant. A cover may enclose a cavity. A cover may mechanically couple to an object to close and/or seal an opening and/or enclose a cavity. A cover may cooperate with the sides of a casing to form a hollow to receive a projectile for launching. Mechanically coupling a cover to a casing may include gluing. A cover may retain a material (e.g., pyrotechnic) inside a cavity of the casing. A cover may cooperate with a casing keep a material inside the cavity dry. A cover may protect a material inside a cavity during transport and handling. A cover may be removed by a force. A cover may be removed by a force provided by an expanding gas. A cover may be at least partially destroyed (e.g., torn, ripped, shredded, burned) by the force that removes the cover. A cover may be rigid. A cover may be flexible. A cover may have a uniform thickness. A cover may be formed of pieces of material, whether the same or different, that are coupled together to form the cover.

A cover may include a conventional gas seal use in conventional 10-20 gauge cartridges for conventional shotguns. The gas seal of a conventional 10-20 gauge shotgun cartridge may be modified so that it is water-resistant and so that it couples to the casing in a water-resistant manner.

In an implementation, casing 420 of cartridge is cylindrical. Casing 420 may be similar in size and shape to a conventional casing for a 12-gauge shotgun cartridge. The outer diameter of the casing may be less toward a front portion as opposed to rear portion 480 (e.g., rim). Casing 420 includes a cavity for receiving pyrotechnic 382. Casing 420 includes an axial bore in rear portion 480 for receiving primer 410. In an implementation, casing 420 is formed of aluminum. In another implementation, casing 420 is formed of materials and in a manner that is comparable to the materials and manner of a conventional shotgun cartridge (e.g., shell) except that it is further processed to be water-resistant.

In an implementation, a forward portion of cartridge 380 has a diameter of about 0.76 inches. Rear portion 480 (e.g., rim) of cartridge 380 has a diameter of 0.88 inches. The forward portion of cartridge 380 may be positioned in bore 370 of barrel 110. Rear portion 480 of cartridge 380 will not enter bore 370 of barrel 110, but contacts and interferes with the breech end portion of barrel 110.

In the above implementation, the difference between the diameter of the forward portion of cartridge 380 and the diameter of rear portion 480 is 0.12 inches. Because forward portion of cartridge 380 is coaxial with rear portion 480, surface 482 is a band (e.g., rim) 0.06 inches wide around the front surface of rear portion 480. Accordingly, the 0.06 inch band is the amount of rear portion 480 that does not enter bore 370 of barrel 110. Further, the 0.06 inch band is the amount of surface of rear portion 480 that may contact the breech portion of barrel 110. In an implementation, cartridge 380 has a length of about 2.85 inches and the thickness of end portion 480 (e.g., rim) is about 0.06 inches. So, all but 0.06 inches of cartridge 380 may be position in bore 370 of barrel 110.

In an implementation, casing 820, and thereby surface 482, are formed of aluminum. Barrel 110 is formed of titanium or stainless steel. Accordingly, the contact between surface 482 and the breech end portion of barrel 110 is contact between dissimilar metals. Surface 482 may form somewhat of a seal with the breech end portion of barrel 110. A force applied by breech cap 120 on rear portion 480 of cartridge 380 may increase the efficacy of any seal formed between surface 482 and a surface of the breech end portion of barrel 110. The seal between surface 482 and barrel 110 may impede the movement of some water from barrel 110 rearward of cartridge 380.

Cartridge 380 further includes seal 340. In an implementation, seal 340 is an o-ring positioned around casing 420. Seal 340 is positioned forward of surface 482. Preferably, seal 340 contacts surface 482. Casing 420 may further include channel 422. Seal 340 may be positioned in channel 422. Channel 422 may retain seal 340 in a position during storage, transport, and use. Channel 422 may positions seal 340 relative to casing 420. Channel 430 may further position seal 340 relative to barrel 110 while cartridge 380 is positioned in the breech end portion of barrel 110. For example, channel 422 is shown proximate to rear portion 480 in FIG. 4. In another implementation, channel 422 and seal 340 may be positioned more forward on casing 420 thereby positioning seal 340 at a more forward position with respect to barrel 110 than the position shown in FIG. 4.

Seal 340 contacts the outer surface of casing 420. When cartridge 380 is position in barrel 110, seal 340 contacts a surface of bore 370 and/or a surface of the breech end portion of barrel 110. While cartridge 380 is positioned in barrel 110, seal 340 forms a seal with the outer surface of casing 420 and an inner surface (e.g., bore, breech end portion) of barrel 110. The breech end portion of barrel 110 may include lip 572 that contacts seal 340 to form a seal. Lip 572 may have a diameter greater than the diameter of bore 370. Seal 340 may exert a resilient force on a surface of lip 572 to aid in removing expended cartridge 380 from barrel 110.

Lip 572 may reduce an area of contact between surface 482 and a surface of the breech end portion of barrel 110 thereby decreasing the efficacy of any seal formed between surface 482 and a surface of the breech end portion of barrel 110.

Contact of seal 340 with casing 820 and the surface of bore 370 and/or lip 572 forms a seal that significantly reduces (e.g., impedes, restricts), if not entirely stops, the movement of water from bore 370 rearward of seal 340 under normal operating conditions. When cartridge 380 is positioned the breech end portion of barrel 110 and breech cap 120 is coupled to barrel 110, pressure applied by breech cap 120 on rear portion 480 of cartridge 380 applies pressure on seal 340 thereby forming a better seal between cartridge 380 and barrel 110.

Because seal 340 restricts the flow of water rearward of cartridge 380, water 372 in barrel 110 completely surrounds casing 420 forward of seal 340. Water is positioned between the sides of casing 420 and the surface of bore 370. Water fills hollow 440 up to cover 486. Because casing 420, cover 486, and the coupling between casing 42 and 486 are water resistant, water 372 does not penetrate casing 420, so pyrotechnic 382 and primer 410 remain dry.

When pyrotechnic 382 burns, the expanding gas presses against the inner surface of casing 420. Depending on the force of the expanding gas and the strength of the walls of casing 420, the expanding gas may expand casing 420 thereby making it a larger diameter, which may result in making it difficult to remove an expended cartridge from barrel 110. However, according to various aspects of the present invention, when the expanding gas presses on the interior surface of casing 420, the walls of casing 420 press on water 372 that surrounds casing 420. Because water is incompressible, the water that surrounds casing 420 helps to reduce the amount that casing 420 expands thereby making it easier to remove the expending cartridge from the barrel after use.

As discussed above, while cartridge 380 is position in barrel 110 and water 372 is in bore 370, water 372 surrounds cartridge 380 up to seal 340 and does not penetrate rearward of seal 340. Preferably, seal 340 is positioned as far rearward on casing 420 as possible so that water 372 surrounds as much of casing 420 as possible. Preferably, water 372 surrounds the majority of cartridge 380 from the front of cartridge 380 to proximate to the forward surface of rear portion 480.

The conventional technique for launching water from a disrupter cannon is to position a flexible plug (e.g., sheet, membrane) into barrel 110 and to push it forward in barrel 110 until it is positioned forward of the cartridge will be positioned when it is inserted. The flexible plug is referred to herein as a rubber device, whether it be formed of rubber, vinyl, plastic, or another material suitable for sealing bore 370. After the rubber device is inserted and positioned, a conventional, non-water-resistant cartridge is inserted into the breech end of barrel 110. Barrel 110 is filled with water and plug 360 inserted as discussed above. The rubber stopper keeps the water in barrel 110 away from the conventional cartridge so that it does not get wet and malfunction. Because the rubber stopper keeps the water away from the conventional cartridge, no water is positioned between the sides of the cartridge and bore 370 to reduce the expansion of the conventional cartridge when fired. When the conventional cartridge is fired, the force of the expanding gas moves the rubber device out of the barrel along with the water.

According to various aspects of the present invention, cartridge 380 is water resistant, so that water 372 cannot penetrate (e.g., enter, seep into, pass through) casing 420 or cover 486, so pyrotechnic 382 and primer 410 remain dry and serviceable. Tests have shown that a cartridge may be fired even after it has been left in a barrel filled with water for thirty days. Further, because water cannot pass rearward past seal 340, water cannot penetrate cartridge 380 from the rear. Because cartridge 380 is water-resistant and seal 340 is positioned toward the rear of cartridge 380, water surrounds cartridge including between the sides of casing 320 and bore 370 providing some protection against expansion of cartridge 380 when it is fired. Seal 340 and the water that surrounds cartridge 380 further reduces the escape of debris and gasses from the burning pyrotechnic rearward of cartridge 380.

According to various aspects of the present invention, while cartridge 380 is positioned in barrel 110 and barrel 110 is filled with water 372, water 372 surrounds cartridge 380. When cartridge 380 is fired, the force of the expanding gas from the burning pyrotechnic 382 is applied to an inner surface of casing 420. The pressure increase inside cartridge 380 tends to expand (e.g., increase the circumference of) casing 420. However, when cartridge 380 is surrounded by water 372, water 372 resists the expansion of casing 420. As a result, casing 420 does not expand to the point of getting jammed in bore 370 and may be more easily removed after cartridge 380 is fired.

When cartridge 380 is fired, cover 486 is blown (e.g., pushed, forced) outward from casing 420. Prior to firing cartridge 380, cover 486 is coupled to casing 420 in a water resistant manner. The force of the expanding gas from the pyrotechnic pushes against the column of water 372 proximate to cartridge 380. The force applied to water 372 pushes plug 360 out of barrel 110. Water 372 is launched out of barrel 110 at a high speed.

Eliminating the conventional rubber device between cartridge 380 and water 372 increases the amount of force transferred by pyrotechnic 382 to water 372 and the resulting force that water 372 can apply to an explosive device.

Testing has shown that a column of water fired using water resistant cartridge 380 can pierce more than double the number of plywood sheets than a water shot launched using a conventional rubber device between the water in the barrel and the cartridge.

Water shots were testing using sheets of one-half inch plywood (e.g., pieces). The sheets were positioned in a rigid frame that held the sheets so that the each side (e.g., surface) of each sheet was positioned one inch from the side of a proximate sheet.

In test no. 1, a disrupter cannon referred to in the market as the Carbon Fire 24 cannon was loaded with a rubber device in the barrel to separate the water from the cartridge. A conventional cartridge loaded with 82 grains of a fast burning pyrotechnic was loaded into the cannon behind the rubber device. The barrel was filled with water (approximately 4.5 ounces) and a plug was inserted into the muzzle end of the barrel to retain the water. The rubber device effectively kept the water from reaching the cartridge. The barrel was aimed at the sheets of plywood so that the column of water would move orthogonally to the plane of the parallel sheets of plywood. The disrupter cannon was fired and the column of water pierced 5 sheets of plywood. The cartridge was dry upon removal, but it has been blown (e.g., forced, push) out of round and a tool had to be used to remove the empty cartridge from the barrel.

In test no. 2, a Carbon Fire 24 cannon was loaded with a rubber device to separate the water from the cartridge. A water resistant cartridge of the invention with 82 grains of a fast burning pyrotechnic was loaded into the cannon behind the rubber device. The barrel was filled with water and plugged at the muzzle end. The cannon was aimed and fired. In this test, the column of water pierced 5 sheets of plywood. Tools were required to remove the cartridge from the barrel because it expanded during firing.

In test no. 3, a Carbon Fire 24 cannon was loaded with a rubber device to separate the water from the cartridge. A water resistant cartridge of the invention with 145 grains of a slower burning pyrotechnic was loaded into the cannon behind the rubber device. The barrel was filled with water and plugged at the muzzle end. The cannon was aimed and fired. In this test, the column of water pierced 5 sheets of plywood. The cartridge was dry when it was removed from the barrel. Tools were not required to remove the cartridge from the barrel, but upon inspection, the cartridge was only slightly expanded by the force of the pyrotechnic.

In test no. 4, a Carbon Fire 24 cannon was loaded with the piston disclosed in the '874 application. As discussed therein, piston 390 includes based 492, wad 494, and seal 350. For this experiment, base 492 was formed of aluminum. A conventional cartridge loaded with 82 grains of a fast burning pyrotechnic was loaded into the cannon behind the piston. The barrel was filled with water and a plug was inserted into the muzzle end of the barrel to retain the water. The piston effectively kept the water from reaching the cartridge. The cannon was aimed and fired. In this test, the column of water pierced 6 full sheets and part of another sheet. The cartridge was dry when removed, but it had been blown out-of-round and tools were required to remove it.

In test no. 5, a Carbon Fire 24 cannon was loaded with piston 390 with an aluminum base as disclosed in the '874 application. A water resistant cartridge loaded with 145 grains of a slow burning pyrotechnic was loaded into the cannon behind the piston. The barrel was filled with water and a plug was inserted into the muzzle end of the barrel to retain the water. The piston effectively kept the water from reaching the cartridge. The cannon was aimed and fired. In this test, the column of water pierced 6 full sheets and part of another sheet. The cartridge was dry when removed. Tools were not required to remove the cartridge from the barrel, but the cartridge was slightly expanded by the force of the pyrotechnic.

In test no. 6, a Carbon Fire 24 cannon was loaded with a water resistant cartridge of the invention with 82 grains of a fast burning pyrotechnic. No rubber device or piston 390 was positioned between the cartridge and the rest of the barrel. The barrel was filled with water. The water contacted and surrounded the cartridge. No water leaked from the barrel pass the seal on the cartridge. The cannon was aimed and fired. In this test, the column of water pierced 11 sheets of plywood. The cartridge was wet when it was removed from the barrel. Tools were required to remove the cartridge from the barrel; however, upon inspection the cartridge was only slightly expanded.

In test no. 7, a Carbon Fire 24 cannon was loaded with a water resistant cartridge of the invention with 145 grains of a slower burning pyrotechnic. No rubber device was positioned between the cartridge and the rest of the barrel. The barrel was filled with water. The water contacted and surrounded the cartridge. No water leaked from the barrel pass the seal on the cartridge. The cannon was aimed and fired. In this test, the column of water pierced 11 sheets of plywood. The cartridge was wet when it was removed from the barrel. No tools were required to remove the cartridge from the barrel. Upon inspection, the explosion from the pyrotechnic had not expanded the cartridge.

The parameters of the above tests are summarized in Table 1 below.

TABLE 1

Test Summary

| Test no. | Factors | Result |
|---|---|---|
| 1 | Conventional cartridge<br>82 grain fast burn pyrotechnic<br>Rubber device in front of cartridge | Water kept away from<br>cartridge 5 sheets pierced<br>Cartridge severely expanded |
| 2 | Water resistant cartridge<br>82 grain fast burn pyrotechnic<br>Rubber device in front of cartridge | Water kept away from<br>cartridge 5 sheets pierced<br>Cartridge expanded |
| 3 | Water resistant cartridge<br>145 grain slower burn pyrotechnic<br>Rubber device in front of cartridge | Water kept away from<br>cartridge 5 sheets pierced<br>Cartridge slightly expanded |
| 4 | Conventional cartridge<br>82 grain fast burn pyrotechnic<br>Piston in front of cartridge | Water kept away from<br>cartridge 6.5 sheets pierced<br>Cartridge severely expanded |
| 5 | Water resistant cartridge<br>145 grain slower burn pyrotechnic<br>Piston in front of cartridge | Water kept away from<br>cartridge 6.5 sheets pierced<br>Cartridge slightly expanded |
| 6 | Water resistant cartridge<br>82 grain fast burn pyrotechnic | Water surrounded cartridge<br>11 sheets pierced<br>Cartridge slightly expanded |
| 7 | Water resistant cartridge<br>145 grain slower burn pyrotechnic | Water surrounded cartridge<br>11 sheets pierced<br>No damage to cartridge |

The above tests were repeated multiple times. After each test, the damage done to the plywood sheets was inspected. The extent of damage done to the sheets varied a lot for test nos. 1-3. At times, some of the sheets were broken in half showing that a greater amount of force had been exerted on that sheet than exerted in an earlier test. The variation in the damage done during test nos. 1-3 appeared to indicate that the amount of force delivered depended on factors that were difficult to control.

The damage done to the plywood sheets during the various repetitions of test nos. 4-5 was much more consistent from test to test and significantly more consistent than variation in the damage done during test nos. 1-3. In test nos. 4-5, the damage done to sheets in sequence (e.g., first, second, third, so forth) appeared to be more similar between the tests thereby indicating that the same amount of force was being consistently delivered to the column of water in test nos. 4-5.

The inconsistency in successive test nos. 1-3 likely is due to the performance of the rubber device used to seal the water from the cartridge. A conventional rubber device is a thin piece of rubber, like the pieces of rubber (e.g., plastic) placed on the ends of threaded pipes to protect the threads from damage. The rubber device is jammed into the barrel to form a seal. The positioning of the rubber device varies from shot to shot and may be a factor in the inconsistent delivery of force to the water.

Further, the rubber device is always ripped or shredded when inspected after a shot. It is believed that the force of the expanding gas damages the rubber device inside the barrel and that the damage to the rubber device affects how the force of the expanding gas is applied to the water thereby affecting the consistency of the force provided in successive shots.

The consistency of the force provided during test nos. 4-5 supports the theory that the rubber device is the cause of the inconsistent damage to the plywood sheets. The piston is not damage during the shot. It appears as though the aluminum base of the piston receives the force of the expanding gas without damage thereby providing a more consistent transfer of force to the water. Further, because the number of sheets pierced in test nos. 4-5 was greater than the number of sheets pierced in test nos. 1-3, the piston appears to transfer a greater amount of the force of the pyrotechnic to the water than is transferred by the rubber device.

Repeated shots of test nos. 6-7 resulted in fairly consistent damage to the sheets thereby indicating a consistent transfer of force to the water and a higher transfer of force to the water because 11 sheets were pierced as opposed to 6.5 or 5 sheets.

Because the column of water launched by the water resistant cartridge alone pierced more sheets than water shots with the rubber device or piston, it is believed that energy from the expanding gas is used to compress air between the cartridge and the rubber device or piston and to move the rubber device or piston out the barrel. The energy used compressing the air or moving the rubber device or piston decreases the force delivered to the water to move the water out the barrel.

The tests were consistent in the damage done to the cartridges. The fast burn powder always did extensive damage to the conventional cartridge so that tools were required to remove the expended cartridge from the breech. The fast burning powder caused less damage to the cartridge of the invention, but still caused the cartridge of the invention to expand at least slightly or more. This result indicates that the construction of the cartridge of the invention appears to be stronger than a conventional cartridge.

The slow burn powder when used in the circumstances of test nos. 3 and 5 always expanded the cartridge, but not to the extent of the fast burn powder. In test no. 7, when the cartridge was surrounded by water, no damage was done to the cartridge. The cartridges used in the successive performances of test no. 7 shows no evidence of damage from expansion.

The varying condition of the expended (e.g., fired) cartridges from the tests appears to indicate that the water surrounding the water-resistant cartridge of the invention provides some additional protection against expansion of the cartridge.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

What is claimed is:

1. A disrupter cannon for launching water in a forward direction toward an explosive device to disable or destroy the explosive device, the disrupter cannon comprising:

a barrel having a breech end portion and a muzzle end portion;

a cartridge comprising a casing, a primer, a pyrotechnic, and a seal, the casing having an interior cavity, the pyrotechnic positioned in the cavity, the casing formed of a water-resistant material, the seal positioned forward of a rear end portion of the casing; wherein while the cartridge is positioned in the barrel with the water:

the seal forms a seal between an outer surface of the casing and an inner surface of the barrel that restricts the flow of water rearward of the seal;

the portion of the casing forward of the seal is surrounded by the water;

the casing resists passage of the water into the cavity so that the pyrotechnic in the cavity remains operable;

igniting the primer ignites the pyrotechnic to launch the water from the barrel; and the water between the outer surface of the casing and the inner surface of the barrel resists the expansion of the casing caused by ignition of the pyrotechnic so that the casing substantially retains the shape.

2. The disrupter cannon of claim 1 further comprising a breech cap wherein:

the breech cap couples to the breech end portion of the barrel;

the breech cap applies a force to the rear end portion of the casing; and the force presses the seal against the outer surface of the casing and the inner surface of the barrel to form a seal between the cartridge and the barrel to restrict the water from moving rearward of the cartridge.

3. The disrupter cannon of claim 1 wherein:

the cartridge further comprises a cover;

the cover is formed of a water-resistant material;

the cover couples to the casing to cover an opening in a forward portion of the casing to form the cavity; and the coupling between the cover and the casing is water-resistant.

4. The disrupter cannon of claim 1 wherein:

the casing further comprises a channel formed in an outer surface of the casing forward of the rear end portion of the casing; and the seal is positioned in the channel.

5. The disrupter cannon of claim 1 further comprising a rim around the rear end portion of the casing, wherein the seal is positioned forward of the rim.

6. The disrupter cannon of claim 1 wherein:

the cartridge further comprises a cover;

the cover is formed of a water-resistant material;

the cover couples to the casing to cover an opening in a forward portion of the casing to form the cavity;

the cover and an inner surface of the casing form a hollow that is open to the barrel and fills with water prior to igniting the pyrotechnic.

7. A disrupter cannon for launching water in a forward direction toward an explosive device to disable or destroy the explosive device, the disrupter cannon comprising:

a barrel having a breech end portion;

a cartridge comprising a casing, a pyrotechnic, and a seal, the casing formed of a water-resistant material, the seal positioned forward of a rear end portion of the casing; wherein while the cartridge is positioned in the barrel with the water:

the seal forms a seal between an outer surface of the casing and an inner surface of the barrel that restricts the flow of water rearward of the seal;

the portion of the casing forward of the seal is surrounded by the water;

the pyrotechnic ignites to launch the water from the barrel.

8. The disrupter cannon of claim 7 wherein:

the cartridge further comprises a primer; and the primer ignites the pyrotechnic to launch the water.

9. The disrupter cannon of claim 7 wherein:

the cartridge further comprises an interior cavity;

the pyrotechnic is positioned in the cavity; and the casing resists passage of the water into the cavity so that the pyrotechnic in the cavity remains operable.

10. The disrupter cannon of claim 7 wherein the water between the outer surface of the casing and the inner surface of the barrel resists the expansion of the casing caused by ignition of the pyrotechnic so that the casing substantially retains the shape.

11. The disrupter cannon of claim 7 further comprising a breech cap wherein:

the breech cap couples to the breech end portion of the barrel;

the breech cap applies a force to the rear end portion of the casing; and the force presses the seal against the outer surface of the casing and the inner surface of the barrel to form a seal between the cartridge and the barrel to restrict the water from moving rearward of the cartridge.

12. The disrupter cannon of claim 7 wherein:

the cartridge further comprises a cover;

the cover is formed of a water-resistant material;

the cover couples to the casing to cover an opening in a forward portion of the casing to form an inner cavity in the cartridge; and the coupling between the cover and the casing is water-resistant.

13. The disrupter cannon of claim 7 wherein:

the casing further comprises a channel formed in an outer surface of the casing forward of the rear end portion of the casing; and the seal is positioned in the channel.

14. The disrupter cannon of claim 7 further comprising a rim around the rear end portion of the casing, wherein the seal is positioned forward of the rim.

15. The disrupter cannon of claim 7 wherein:

the cartridge further comprises a cover;

the cover is formed of a water-resistant material;

the cover couples to the casing to cover an opening in a forward portion of the casing to form an inner cavity in the cartridge; and the cover and an inner surface of the casing form a hollow that is open to the barrel and fills with water prior to igniting the pyrotechnic.

* * * * *